US007441570B2

(12) United States Patent
Hagleitner

(10) Patent No.: US 7,441,570 B2
(45) Date of Patent: Oct. 28, 2008

(54) DISPENSING VALVE

(76) Inventor: Hans Georg Hagleitner, Lindenallee 11, Zell am See (AT) A-5700

( * ) Notice: Subject to any disclaimer, the term of this patent is extended or adjusted under 35 U.S.C. 154(b) by 163 days.

(21) Appl. No.: 11/073,904

(22) Filed: Mar. 7, 2005

(65) Prior Publication Data

US 2005/0194061 A1 Sep. 8, 2005

(30) Foreign Application Priority Data

Mar. 5, 2004 (AT) ..... A 379/2004

(51) Int. Cl.
*B65B 1/04* (2006.01)

(52) U.S. Cl. ..... 141/301; 141/351

(58) Field of Classification Search ..... 141/349–351, 141/301, 302, 59; 222/566–571, 484, 514, 222/518, 525

See application file for complete search history.

(56) References Cited

U.S. PATENT DOCUMENTS 1,428,744 A 9/1922 Bastian et al.
5,249,611 A * 10/1993 Law ..... 141/198
5,431,205 A * 7/1995 Gebhard ..... 141/351
5,526,961 A * 6/1996 Burrows ..... 222/185.1
5,535,794 A * 7/1996 Posly ..... 141/351
5,715,877 A 2/1998 Sandor
5,944,300 A 8/1999 Gillard et al.
6,045,119 A 4/2000 Erb
6,478,058 B1 * 11/2002 Pears ..... 141/353
6,488,058 B1 * 12/2002 Dyer et al. ..... 141/346
6,598,630 B1 * 7/2003 Trippi, Jr. ..... 141/350
6,923,345 B1 * 8/2005 Laible ..... 222/185.1
2002/0074533 A1 6/2002 DeCler et al.

FOREIGN PATENT DOCUMENTS

| | | |
|---|---|---|
| DE | 51107 | 3/1890 |
| DE | 478432 | 6/1929 |
| WO | 93-13009 | 7/1993 |
| WO | 99/18026 | 4/1999 |
| WO | 01/02283 A1 | 1/2001 |
| WO | 01/28914 A1 | 4/2001 |

* cited by examiner

*Primary Examiner*—Steven O Douglas
(74) *Attorney, Agent, or Firm*—Laurence A. Greenberg; Werner H. Stemer; Ralph E. Locher

(57) ABSTRACT

A discharge valve for a container (1) containing a flowable medium, having a movable valve part (10) which, in a rest position, keeps an outlet closed, has at least two open positions with different outlet cross sections.

11 Claims, 3 Drawing Sheets

DISPENSING VALVE

BACKGROUND OF THE INVENTION

Field of the Invention

The invention relates to a discharge valve for a container containing a flowable medium, having a valve part which is movable into an open position and, in a rest position, keeps an outlet closed, and to a container provided with a discharge valve of this type.

Discharge valves of this type are arranged in a closure element of the container opening into which they are inserted and fixed generally after filling has taken place. In order to be able to remove the container contents in particular portion by portion, the valve part is moved into the open position, for which various possibilities are provided.

The valve part can be rotated. WO 99/18026 or U.S. Pat. No. 5,715,877 shows one example of a metering device with a rotatable valve part.

The valve part can be displaced axially. WO 93/13009 shows one example of a metering device with an axially displaceable valve part.

The valve part can be rotated and displaced axially.

WO 01/28914 shows one example of a metering device with a valve part of this type.

When the valve is opened, a certain quantity of medium flows out, with the size of the opening cross section depending on the opening time, for example on the duration of actuation of a corresponding handle.

SUMMARY OF THE INVENTION

The invention now provides a discharge valve by means of which it is optionally possible for at least two different quantities to be removed from the container per unit of time by the discharge valve having at least two open positions with different outlet cross sections.

A discharge valve is preferably assigned one actuating handle per open position, so that the valve part is transferred into the particular open position through selection of the handle.

Each of the three abovementioned possibilities is conceivable for the transfer into the open positions. If the container is inserted upside down into a metering device, then provision is made, in a preferred embodiment, for the valve part to be height-adjustable, and for the two open positions to be provided one above another. During the height adjustment of the valve part, the individual open positions are therefore reached successively, the sequence not being of importance per se. However, provision is preferably made for the valve part, after a short opening travel, to open up a small outlet cross section in the first open position and, after a longer opening travel, to open up the larger outlet cross section in the second open position.

Each outlet cross section is determined in particular by discrete outflow openings which are provided successively in the opening travel. This affords the advantage that the quantity emerging from the container is not dependent on the precise handling of the valve part, with the result that inaccuracies of any type, for example in the production of the discharge valve, in the production of the container, in the actuating mechanism of the metering device, etc., do not have any effect on the metered quantity. The particular travel length until the corresponding outflow opening is opened up is therefore noncritical.

In the thoroughly conceivable possibility of the outlet cross section being enlarged continuously by the movement of the valve part, this clearance is not provided. In such an embodiment an adjusting device is then preferably provided.

When a first outflow opening is opened in the first open position, and a second outflow opening is opened in the second open position, two different possibilities are provided. Firstly, the first outflow opening can remain open, so that the larger outlet cross section is produced from the sum of the two outflow openings, in which case the second outflow opening can be smaller, identical or larger, since it always complements the first outflow opening.

In the second case, the first outflow opening is closed again when the second is opened. In this case, the second outflow opening is larger if, as preferably specified above, the second outflow opening is to have the larger outlet cross section, and smaller, if the first outflow opening is to have the larger outlet cross section.

One preferred embodiment of the discharge valve makes provision for the discharge valve to have a hollow-cylindrical closure element which can be inserted into the valve opening and in which the movable valve part is sealingly guided in the manner of a piston, and for the outlet openings to be formed by at least two axially offset holes in a side wall of the closure element, which holes, during the stroke of the valve part, connects the container interior to the surroundings in terms of flow. If the container does not have flexible, but rather essentially stiff walls, then provision is furthermore made for the valve part to have an axial air inlet duct.

Two exemplary embodiments of the invention are described in more detail below with reference to the figures of the attached drawing, without being limited thereto.

DESCRIPTION OF THE PREFERRED EMBODIMENTS

Figure 1:
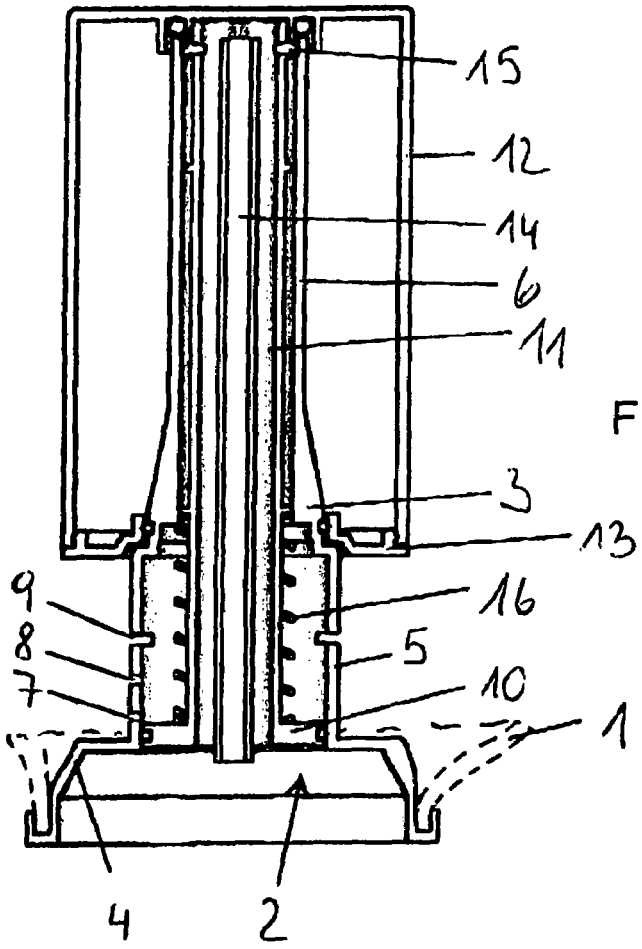
FIG. 1 is an axial section through a discharge valve inserted into an upside-down container, in the closed or rest position.
Figure 2:
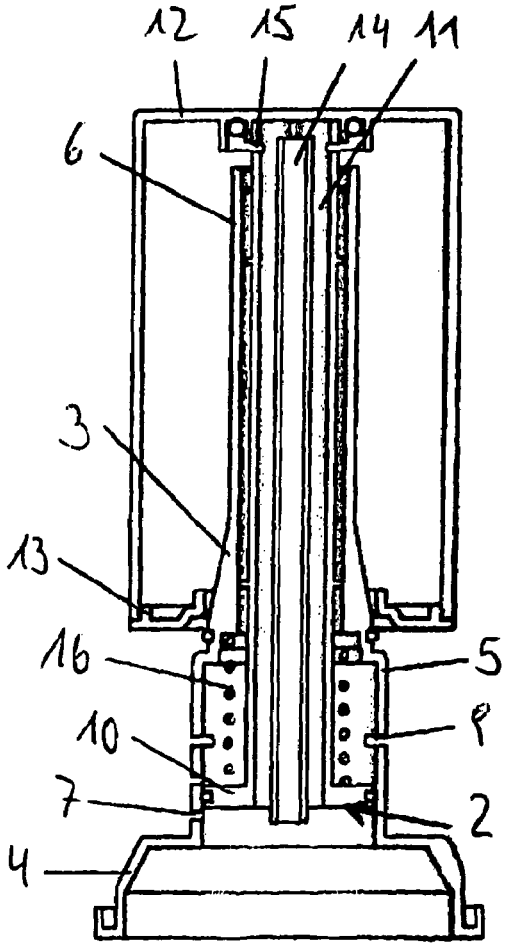
FIG. 2 shows the discharge valve in a first open position.
Figure 3:
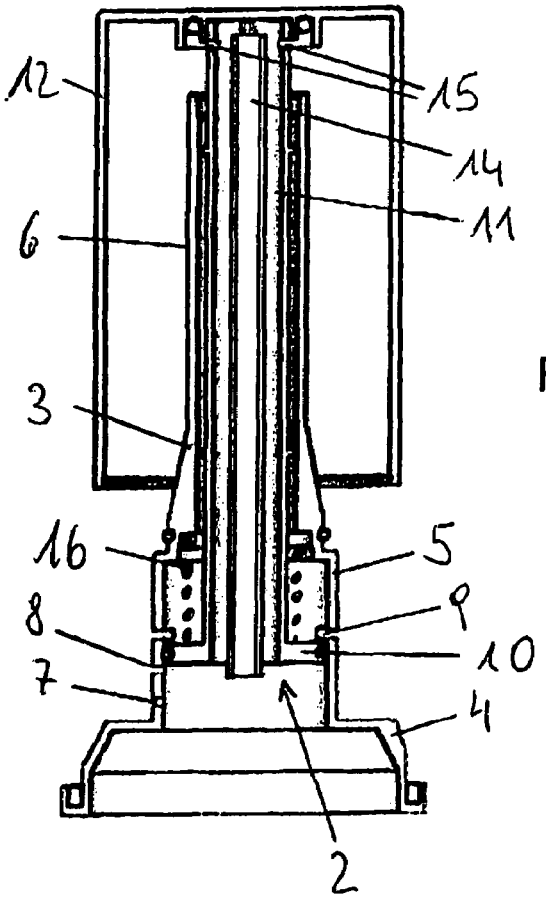
FIG. 3 shows the discharge valve in a second open position.

A discharge valve 2 has a closure element 4 which is matched to the cross section of the opening of a container 1 and, after the filling of the container 1 with a flowable medium, for example a detergent or disinfectant concentrate, is inserted into the container opening and fixed permanently, for example bonded or welded. The closure element 4 is provided with a tubular section 5 which protrudes into the interior of the container 1 and merges via a converging guide part 3 into a tubular section 6 which has a smaller diameter than the tubular section 5.

In the exemplary embodiment shown, the tubular section 5 has three outflow openings 7, 8, 9 arranged one above another. In the closed position according to FIG. 1 or 5, a piston-like valve part 10 extends in an outermost position, in which a connection in terms of flow between the interior of the container 1 through the outflow openings 7, 8, 9 to the outside is interrupted. A compression spring 16 which presses the valve part 10 into the closed position is provided between the valve part 10 and the converging guide part 3.

The piston-like valve part 10 has an inwardly extending air inlet tube 11 which is guided centrally in the tubular section 6 at a distance thereto. In the embodiment shown for upside-down containers, a cup-like covering 12 which has a lower centering ring 13 is placed onto the inner end of the air inlet tube 11. At the lower end of the air inlet tube 11 an annular sealing edge 20 can be formed, as FIG. 5 shows.

The covering 12 contains a certain volume of air and prevents the flowable medium from being able to penetrate into the air inlet tube 11. For air to pass from the inlet tube 11 into the covering 12, holes 15 are provided in the upper end region. In the embodiment according to FIGS. 1 to 4, a further tube 14 is held in the interior of the inlet tube 11 via webs (not shown), said tube protruding slightly from the inlet tube 11 at the side of the valve part 10 and ending at a small distance from the covering 12. The further tube 14 causes the air flowing in to be divided between two ducts, so that even if flowable medium penetrates into the air inlet tube 11, ventilation can take place via the further tube 14.

Figure 5:
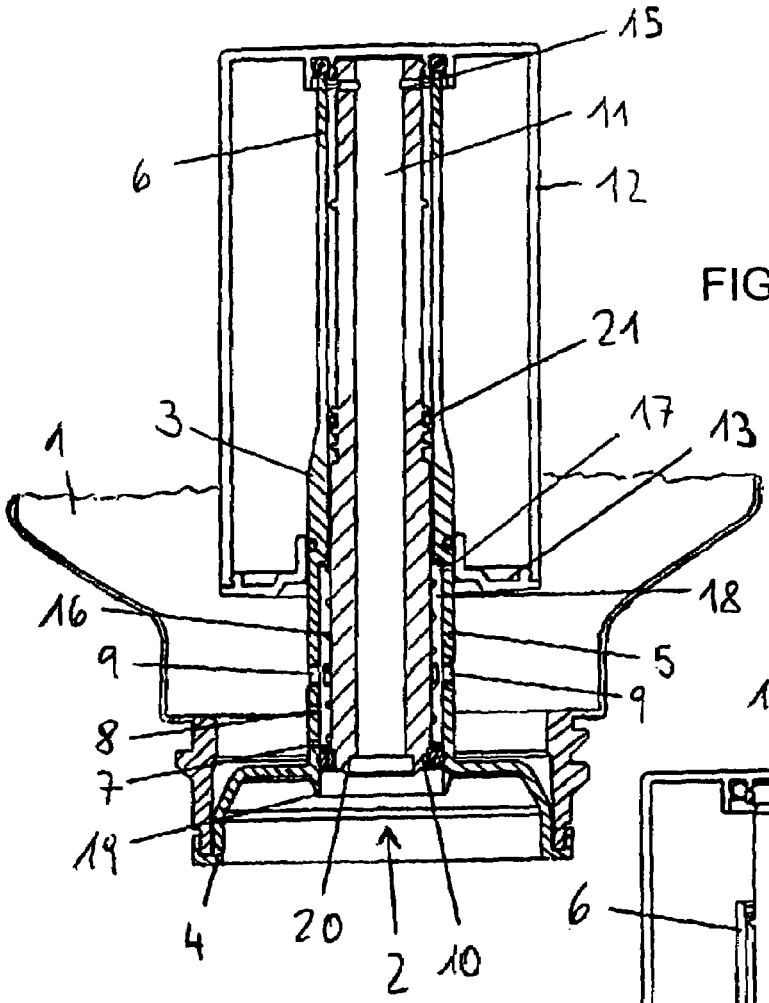
FIGS. 5 and 6 show axial sections according to FIGS. 1 and 4 through a second exemplary embodiment.
Figure 6:
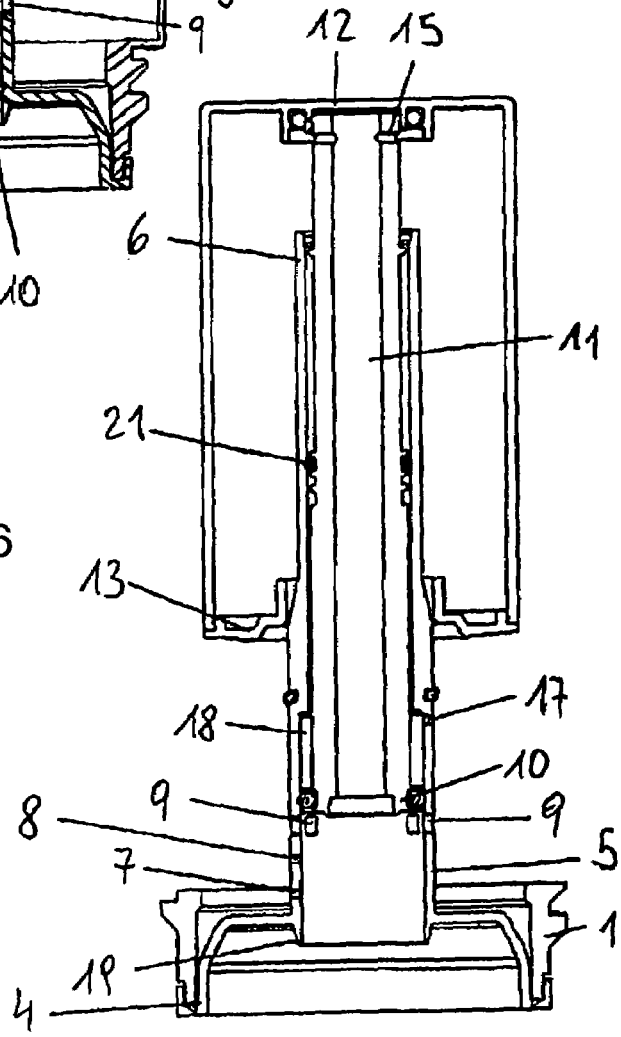

In the embodiment according to FIGS. 5 and 6, this further tube is absent, since the penetration of flowable medium through the annular gap between the tubular section 6 of the closure element 4 and the air inlet tube 11 is prevented by an approximately centrally arranged sealing ring 21.

In the closed position according to FIG. 1 or 5, the covering 12 is seated in a sealing manner on the end of the tubular section 6 and the centering ring 13 is seated in a sealing manner on the guide part 3. In order to open the valve and allow a first quantity of the flowable medium to flow out of the container 1 downward, the valve part 10 is raised to such an extent that the lowermost outflow opening 7 is opened up. Together with the lifting of the valve part 10, the covering 12 is also lifted from its sealed seat at the end of the tubular section 6 and the guide part 3, so that air can flow through the holes 15 into the covering 12 and through the lower centering ring 13 thereof into the interior of the container 1.

Figure 4:
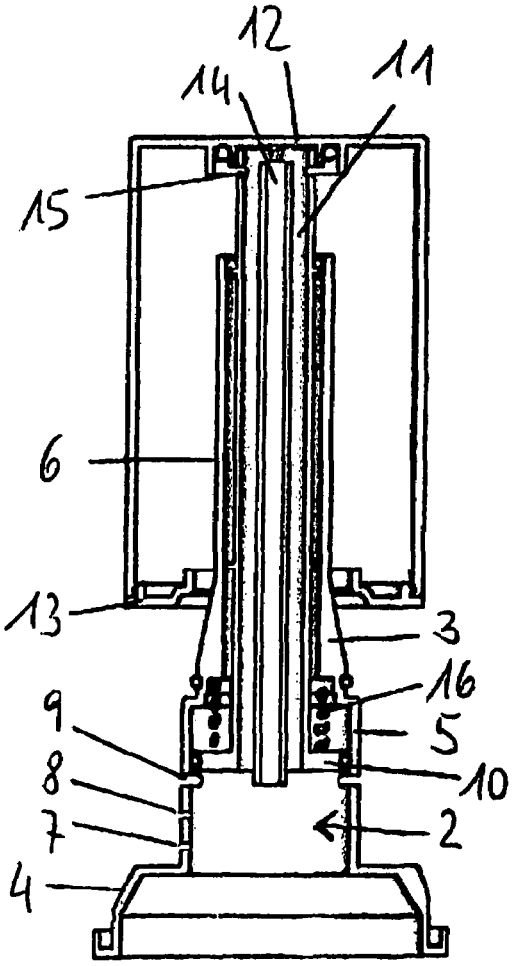
FIG. 4 shows the discharge valve in a third open position.

If a relatively large quantity of flowable medium is to be removed from the container in the same unit of time, then the valve part 10 is lifted by a greater height (see FIG. 3), so that the next higher outflow opening 8 is additionally opened up. The entire outflow cross section is correspondingly larger as a result. FIGS. 4 and 6 shows a third open position, in which the valve part 10 is raised even higher, so that all of the uppermost outflow openings 9 are exposed. The flowable medium can therefore flow out downward through the tubular section 5 through all three openings 7, 8, 9 in a correspondingly large quantity per unit of time, with, in the embodiment according to FIGS. 5 and 6, an annular drip hood 19 being formed at the lower end of the tubular section 5. The space 18 receiving the spring 16, as FIGS. 5 and 6 show, can be assigned a vent opening 17 in order to allow the air which is to be displaced during the raising of the valve part 10 to flow out.

I claim:

1. A combination, comprising:

a container containing a flowable medium and having a container opening; and a discharge valve disposed in said opening and substantially completely in an interior of said container, said discharge valve having a valve part movable into a rest position for closing an outlet and into at least first and second open positions for discharging the flowable medium, said first open position having a given first outlet cross section defined by a first discrete outflow opening and said second open position having a given second outlet cross section different from said first outlet cross section;

said second outlet cross section defined by at least one of:

a second discrete outflow opening, and said second outflow opening and said first outflow opening.

2. The combination according to claim 1, wherein said container is an upside-down container, said valve part is height-adjustable, and said first and second open positions are disposed one above another.

3. The combination according to claim 1, wherein said valve part is configured to:

after a short opening travel, open up a relatively small outlet cross section in the first open position;

after a medium opening travel, open up a larger outflow cross section in the second open position; and after a longer opening travel, open up a largest outlet cross section in a third open position.

4. The combination according to claim 1, wherein said first outflow opening is opened in the first open position, and said second outflow opening is opened in the second open position.

5. The combination according to claim 4, wherein said first outflow opening and said second outflow opening are opened in the second open position.

6. The combination according to claim 4, wherein only said second outflow opening is opened in the second open position.

7. A combination, comprising:

a container containing a flowable medium and having a container opening; and a discharge valve disposed in said opening and substantially completely in an interior of said container, said discharge valve having a valve part movable into a rest position for closing an outlet and into at least first and second open positions for discharging the flowable medium, said first open position having a given first outlet cross section and said second open position having a given second outlet cross section different from said first outlet cross section;

a first outflow opening and a second outflow opening and;

a hollow-cylindrical closure element insertable into said container opening and sealingly guiding therein said movable valve part in a cylinder/piston relationship, and wherein said outflow openings are formed by at least two axially offset holes in a side wall of said closure element, and said holes, during a stroke of said valve part, fluidically connect a container interior to the surroundings.

8. The combination according to claim 1, wherein said valve part has an axial air inlet duct.

9. The combination according to claim 1, wherein said second outlet cross section does not include said first outflow opening.

10. The combination according to claim 1, wherein said first outlet cross section does not include said second outflow opening, and said second outlet cross section includes at least said first outflow opening and said second outflow opening.

11. The combination according to claim 1, wherein said first outlet cross section is sized for discharging the flowable medium at a first predetermined flow rate, and said second outlet cross section is sized for discharging the flowable medium at a second predetermined flow rate that is different from said first predetermined flow rate.

* * * * *